United States Patent [19]

Janson

[11] 4,452,579

[45] Jun. 5, 1984

[54] APPARATUS FOR PRODUCING TABLETS

[75] Inventor: Helmut Janson, Cologne, Fed. Rep. of Germany

[73] Assignee: Kilian & Co. GmbH, Cologne, Fed. Rep. of Germany

[21] Appl. No.: 402,855

[22] Filed: Jul. 29, 1982

[30] Foreign Application Priority Data

Aug. 7, 1981 [DE] Fed. Rep. of Germany ..... 3131402

[51] Int. Cl.[3] ..... B28B 17/00

[52] U.S. Cl. ..... 425/140; 425/149

[58] Field of Search ..... 425/140, 149

[56] References Cited

U.S. PATENT DOCUMENTS 3,063,390 11/1962 Frank ..... 425/140
4,030,868 6/1977 Williams ..... 425/149
4,062,914 12/1977 Hinzpeter ..... 425/149
4,238,431 12/1980 Stüben et al. ..... 425/149
4,373,888 2/1983 Yamamoto ..... 425/149
4,396,564 8/1983 Stüben et al. ..... 425/149

*Primary Examiner*—James R. Hall
*Attorney, Agent, or Firm*—Body, Vickers & Daniels

[57] ABSTRACT

An apparatus for producing tablets from particulate material having a weight between preselected weight limits wherein a metered quantity of particulate material is compressed in a die to form a tablet having a preset thickness. The final compression pressure is measured and compared to preselected pressure limits. The metered quantity is adjusted if the measured pressure is outside the pressure limits. At selected time intervals, the tablets are weighed and if the tablet weight is outside the preselected weight limits, the pressure limits and/or the preset thickness is adjusted to bring the tablet weight within the weight limits.

11 Claims, 1 Drawing Figure

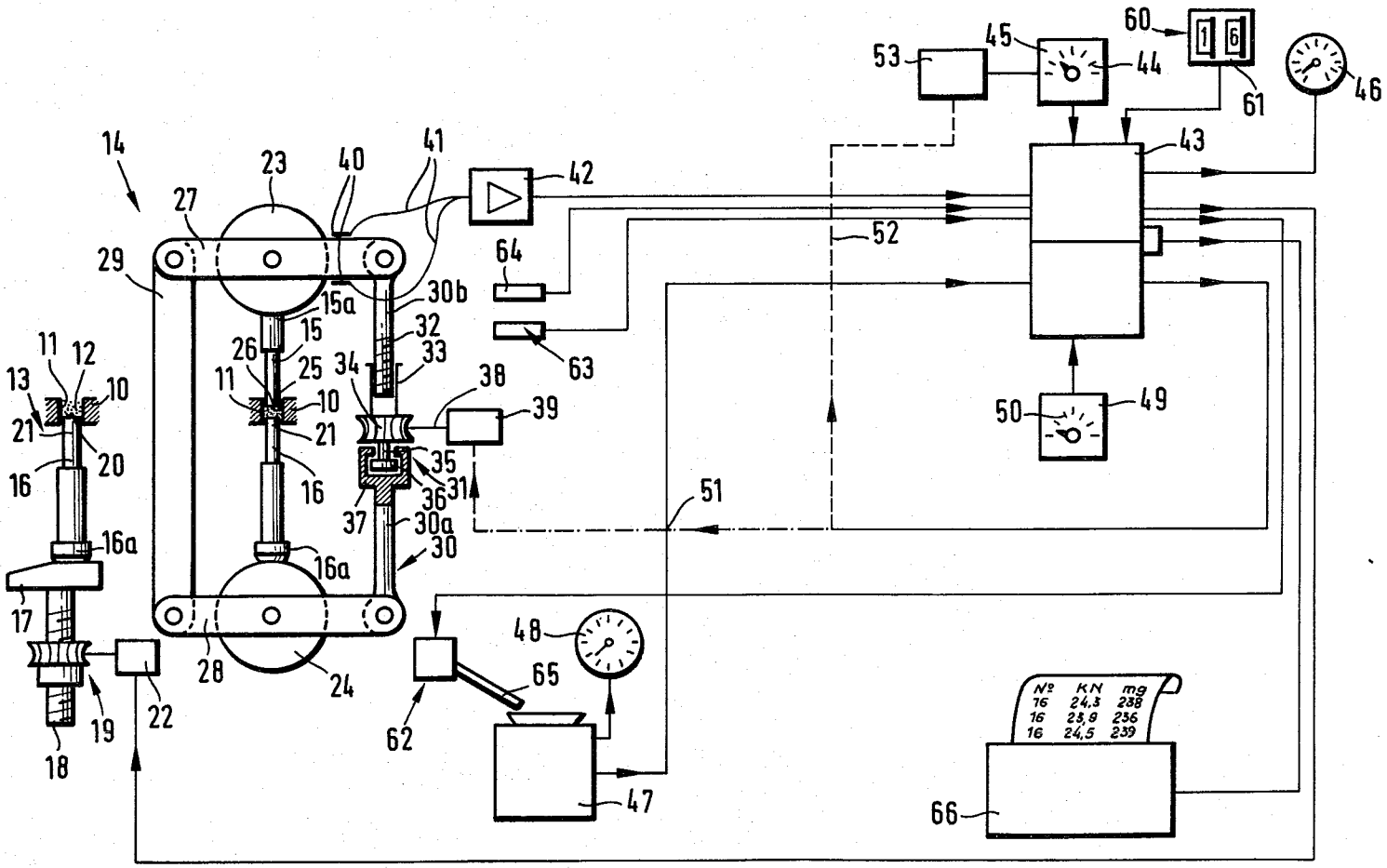
Nº KN mg
76 24,3 238
76 23,9 236
76 24,5 239

APPARATUS FOR PRODUCING TABLETS

FIELD OF THE INVENTION

This invention relates to an apparatus for producing tablets of substantially constant weight, and is particularly suitable for application in rotary die tablet presses used in the serial production of tablets.

BACKGROUND OF THE INVENTION

A known method for consecutively producing tablets comprises feeding a metered quantity of particulate material into a die bore, compressing it to a pre-set thickness to form the tablet, measuring the final compression pressure and comparing this to lower and upper preselected pressure limits and increasing or respectively decreasing the metered quantity of particulate material fed into the die bore for subsequent tablets depending on whether the measured pressure respectively falls below the lower or exceeds the upper preselected pressure limit.

A known tablet press for use in this method comprises a die plate having a bore for receiving particulate material; an adjustable dosing device for feeding a metered amount of particulate material into the bore for forming each tablet; upper and lower rams reciprocable together in a compression stroke in the bore to compress the particulate material into a tablet and having a preset separation of the rams at the end of this compression stroke which preset separation determines the thickness of the tablet formed; means for measuring the compression pressure existing at the end of the rams' compression stroke; means for comparing said measured pressure with preselected upper and lower desired pressure limits and for generating a pressure error signal if said limits are exceeded by the measured pressure; and adjustment means responsive to said pressure error signal for varying the amount of particulate material fed to the bore by the dosing device until the measured pressure on subsequent compression strokes falls within the preselected upper and lower limits. This adjustment means may be a servo-motor controlling the dosing device.

In order to produce a plurality of tablets of approximately equal weight in a tablet press, it is thus known to monitor the pressures which occur in the press rams and in the remaining structural parts of the pressing apparatus during the pressing of the individual tablets. In this case the quantity of material which is charged into each die bore is modified by adjusting the dosing device as a function of variations in the pressure. It is assumed for this purpose that the pressure is an approximately linear function of the volume of material in the die, and hence also of the weight of the tablet pressed in the die from the material present there. If the measured pressure increases, then the quantity of material in the dies is reduced and vice versa, so that the pressure once again measures its desired value. The attempted maintenance of constant weight in the consecutively produced tablets therefore depends solely upon the maintenance of constant pressure.

The density of all the tablets produced can be monitored with such a regulating device; it is however even so possible that the tablets produced may deviate from the desired weight. The reason for this lies in the fact that, on the one hand, pressure variations are not exclusively attributable to erroneous dosings, and on the other hand that not every variation in the volume of material in the dies results in a pressure variation, because in addition to the volume of particulate material in the dies, density, moisture, grain size and grain composition or grain graduation of the material also have an influence upon the weight of the finished pressed tablet. It is therefore entirely possible for the pressure to remain constant, but for the weight of the finished tablets to vary nevertheless.

In order to maintain the tablet weight constant and to prevent the weight of any tablet deviating from the desired weight, it would be necessary to weigh each individual tablet. In the current state of the art of weighing machine construction however, it is not yet possible to construct for a reasonable outlay a weighing machine which operates even approximately as fast as a modern rotary tablet press, which rotates with a peripheral speed of over 2.5 m/sec. and turns out more than 80 tablets per second.

It is the aim of the invention to monitor the tablet weight in addition to the compression pressure and to allow for variations in the weight of the tablet in the regulation of the process and thereby to produce a regulating installation capable of maintaining the tablet weight substantially constant to a much greater extent than in the prior art.

SUMMARY OF THE INVENTION

According to an aspect of the invention is provided with a tablet press for producing tablets from particulate material comprises a die plate having a bore for receiving particulate material; an adjustable dosing device for feeding a metered amount of particulate material into the bore for forming each tablet; upper and lower rams reciprocable together in a compression stroke in the bore to compress the particulate material into a tablet and having a preset separation of the rams at the end of this compression stroke which preset separation determines the thickness of the tablet formed; means for measuring the compression pressure existing at the end of the rams' compression stroke; means for comparing said measured pressure with preselected upper and lower desired pressure limits and for generating a pressure error signal if said limits are exceeded by the measured pressure; adjustment means responsive to said pressure error signal for varying the amount of particulate material fed to the bore by the dosing device until the measured pressure on subsequent compression strokes falls within the preselected upper and lower limits;

means for sampling the tablets produced at spaced time intervals and weighing each tablet so sampled;

means for comparing the weight of each tablet so sampled to preselected upper and lower weight limits and for generating a weight error signal if said limits are exceeded; and means responsive to the weight error signal for varying the present separation of the rams at the end of the compression stroke and/or the predetermined lower and upper limits of the pressure until the weight of further sampled tablets falls within the preselected weight limits.

The invention is based on the discovery that random sampling for weighing of the tablets at intervals is sufficient to achieve good results because abrupt weight variations, e.g. due to the charging of a material of totally different composition, do not generally arise and are in any case detected by the known pressure regulating device, which immediately corrects these greater deviations or stops the machine. However, weight variations which occur very slowly and in a relatively small degree due to a variation in the quality of the material and which the pressure regulation does not compensate for can be detected and eliminated sufficiently rapidly by random samples which are taken at relatively long time intervals, without the need for expensive high speed weighing apparatus.

By varying the preset thickness of the tablets to be produced it is possible to take the weight variation into account as an additional parameter in the production of the tablets, if variations in the weight of the tablets detected as random samples automatically effect a variation in the tablet thickness. Thus in the case of too high a weight of the tablets the thickness adjustment is reduced, so that the compression pressure measured for tablets subsequently compressed initially rises, and through the known regulating device, reduces the charge volume of material to the dies until the pressure again falls within the preselected upper and lower values. The tablets have then become thinner, and their weight has become less, but the tablets are made within the same pressure limits as previously. If the density of the material from which the tablets are produced fluctuates, these density fluctuations are expressed only as fluctuations in the thickness of the tablets. The weight of the tablets remains constant.

If, also according to the invention the preselected limit values for the compression pressure are modified as a function of the weight of the weighed tablets, then the known pressure regulating device reacts in order to achieve a compression pressure within the new limits. If e.g. in the case of unduly heavy tablets an adjustment is made so that both the upper and the lower preselected pressure limits are lowered, then the measured pressure for the next tablet produced will immediately exceed the new upper limit and the pressure regulating system reduces the charge of material to the dies. By this means the density of the tablets is reduced while their thickness is maintained constant, and their weight is restored to within the desired weight limits.

In a preferred embodiment both the means for measuring the compression pressure and the means for sampling and weighing produce signals corresponding to the weight and pressure respectively, which are fed to a computer which forms both the means for comparing said measured pressure and the means for comparing the weight of each tablet.

In one embodiment both rams are acted on by responsive pressure rollers mounted in bearings and the means for measuring the compression pressure comprises measuring devices mounted in the bearings of the pressure rollers, and a servo-motor is provided for reciprocating the bearings away from or towards each other thereby to adjust the pre-set separation of the rams at the end of their compression stroke, said servo-motor forming the means responsive to the weight error-signal. The bearings may be mounted on bearing arms which are interconnected by at least one tie rod to form an articulated frame, and the length of the tie rod(s) may be adjusted by an adjusting gear which is driven by the servo-motor.

Additionally, or as an alternative, a mechanical device may be provided for presetting said preselected upper and lower pressure limits having a servo-motor for varying the limits selected, said servo-motor forming said or part of said means responsive to the weight error signal.

It is particularly suitable if either or both the servo-motors are a step motor, with the length of the step determined by the magnitude of the weight error signal or pressure-error signal respectively.

If the embodiment with a computer is used, the computer may also control a printer providing a print-out of the weights of the sampled tablets, and where the press is a rotary die press having a plurality of cooperating pairs of rams, the computer may also control the printer to identify the pair of rams associated with each weighed sample tablet.

The means for sampling and weighing tablets may comprise a steering device for selecting and separating single tablets and a weighing device to which these tablets are fed. The tablet thickness adjustment and the adjustment of the prescribed pressure values as a function of the weight variations in the case of tablets taken as random samples may also be performed in combination if the tablet properties so require. In this case the computer determines the two signal fractions, conveniently separately.

DESCRIPTION OF THE DRAWINGS

Further features and advantages of the invention will emerge from the following description and from the drawing, in which a preferred embodiment of the invention is explained more fully with reference to a schematic example. The drawing shows the charging station and the pressing station of a rotary tablet press in a schematic partial elevation and a block circuit diagram which shows the function of the individual parts.

DESCRIPTION OF THE PREFERRED EMBODIMENT

In the drawing, 10 designates the die turntable of a rotary tablet press, not shown in detail here, which is provided with a plurality of die bores 11, into which the material 12 is charged in the dosing station 13 and is pressed into tablets by top rams 15 and bottom rams 16 in the pressing station 14. Associated with each die bore 11 are a top ram 15 and a bottom ram 16, which revolve conjointly with the die turntable 10 and slide with their ram feet **15*a* and 16*a*** respectively along guide rails so that they can perform an upward and downward movement during their revolution.

In the region of the dosing station 13 there is arranged a dosing rail 17, which is mounted on a spindle 18 and is vertically adjustable by a worm transmission 19. The bottom rams 16 travel with their ram feet **16*a* across the dosing rail 17 and enter their respective die bores 11 from beneath, while the top end face 20 of the ram head 21 of the bottom ram 16 limits the charge volume for the material 12 in the die bore 11. The worm transmission 19 for the vertical adjustment of the dosing rail 17 has a servo-motor 22**, which is set in motion in a manner to be described more fully below.

In the pressing station 14 the top rams 15 and the bottom rams 16 pass between a top pressure roller 23 and a bottom pressure roller 24, while the ram head 21 of the relevant bottom ram 16 and the ram head 25 of the relevant top ram 15 compress the material 12 in the die bore 11 to form the desired tablet 26. The pressure rollers 23 and 24 are mounted rotatable in bearing arms 27 and 28 which are connected at their ends by tie rods 29 and 30 to form an articulated frame. The tie rod 30 consists of a lower part **30*a* and an upper part 30*b*, which are mutually connected by an adjusting gear 31 so that the length of the tie rod 30 is variable. For this purpose the upper part 30***b* of the tie rod 30 has a screwthread 32 and is screwed into a screwthreaded bushing 33 which is fixed coaxially on a worm gear 34 which carries on its opposite end face a shaft 35 with a widened disc 36. This disc is mounted rotatably in a claw 37 which is fixed to the bottom part 30*a* of the tie rod 30 and partly overlaps the top side of the disc 36. The worm gear 34 is set in rotation by a worm 38 which is in turn driven by a servo-motor 39 which is part of the regulating installation to be explained more fully below.

The bearing arms 27 of the top pressure roller 23 are provided with extensometer strips 40, the measured values of which are fed by conductors 41 to a measuring amplifier 42.

When a pair of rams 15,16 passes between the pressure rollers 23 and 24, pressures which are generated in the rams 15 and 16 are transmitted through the pressure rollers 23 and 24 into the support means 27, 28, 29 and 30, where they generate deformations which are detected by the extensometer strips 40, so that they result in a variation in the electrical resistance of the latter. Since these variations are extremely small, they are amplified by the measuring amplifier 42 and fed as actual pressure values to an electronic computer 43 which compares these actual pressure values with an upper and a lower desired pressure value, which are fed to the electronic computer 43 from a device 44 to adjust the desired pressure values. The desired pressure values may be read off on a scale 45 of the adjusting device 44 for the desired pressure values, while the actual pressure values are displayed on an indicating device 46.

The pressure output values emitted by the electronic computer 43 are fed to the servomotor 22 for the vertical adjustment of the dosing rail 17, which by raising or lowering the bottom rams 16 travelling across the latter reduces or increases the charge volume in the die bore 11, according to whether the actual pressure value is greater or smaller than the upper and lower limit pressure values prescribed by the pressure adjusting device 44.

To make it possible to monitor not only the pressure during the pressing of the tablets, but also the weight of the tablets from time to time, and to regulate the tablet press in accordance with the weight variations, according to the invention a weighing device 47 with weight indicating means 48 is provided. In this weighing device 47 individual finished tablets from the stream leaving the tablet press are weighed at regular time intervals. The measured values converted into electrical signals are fed as actual weight values in the form of input signals to the electronic computer 43, which compares them with an upper and with a lower desired weight value which are adjusted on a weight adjusting device 49 and prescribed to the computer and which may be read off on a scale 50. The weight output signals leaving the electronic computer 43 are fed either through a conductor 51 to the servo-motor 39 for the drive of the adjusting gear 31 for the length of the tie rod 30, or through a conductor 52 to a servo-motor 53 by which the prescription of the desired pressure values in the desired pressure value adjusting device 44 can be modified.

If the actual tablet weight is higher than the desired weight adjusted at the weight prescription point 49, then when the servo-motor 39 is modulated the worm gear 34 is rotated by the worm 38 so that the screwthread 32 in the tie rod part 30*b* is screwed into the screwthreaded sleeve 33, and the tie rod 30 is therefore shortened. The pressure rollers 23 and 24 therefore move towards each other, so that the ram heads 21 and 25 of top ram 15 and bottom ram 16 also approach each other and compress the material 12 in the die bore 11 more intensely. This causes the pressure in the rams and in the bearing parts 27, 28, 29 and 30 in the pressing station 14 to rise, the actual pressure values generated by the extensometer strips 40 become greater and the computer 43 emits pressure signals which cause the servomotor 22 to raise the dosing rail 17 through the adjusting drive 19 and thereby to reduce the charge volume of the die bores 11. In this context it should be pointed out that a delay exists between the pressure input signal and the pressure output signal, which approximately compensates the time interval which exists between the passage of the die bore between the dosing station 13 and the pressing station 14.

It will be seen that by adjusting the preset separation of the ram heads 21 and 25 the tablet thickness is modified, whereas the density of the tablets and the pressure exerted remains constant.

If, e.g. in the case of an increase in the weight of certain of the tablets weighed by the weighing device 47, the servo-motor 53 is modulated through the conductor 52, it adjusts the desired pressure values downwards, i.e. the admissible limit range limited by the desired values is displaced downwards. This has the result that the electronic computer determines that the permissible pressure limits have been exceeded and feeds to the servomotor 22 pressure output signals which cause the servomotor 22 to raise the dosing rail 17 and the bottom rams 16 travelling along it, whereby the charge volume of the die bores 11 is reduced and a smaller quantity of material is available for each tablet. Then a smaller quantity of material is compressed by the rams 15 and 16 in the pressing station 14 to the same thickness as previously. The tablet produced has the same thickness as the previous one, but a lower density. The correct weight of the tablet is therefore achieved here by a reduction in the density.

The modulation of the servo-motors 22, 39 and 53 occurs by steps, the step length being determined by the computer 43 from the magnitude of the deviation from the desired values In order to enable the monitoring of the weight to be performed systematically and to obtain a written record of the entire production cycle, on the basis of which, on the one hand the operation of the regulating installation and on the other hand the constitution of the tablets produced by the machine can be evaluated, a control means for the removal of the tablets to be weighed each time, and a printing device which prints out the actual values of the individual weighed tablets which are fed to the computer are provided.

The control device which is generally designated 60, consists of an adjusting device 61, conveniently for manual actuation, by which the number of the particular pair of press rams of the press rams revolving with the die, the tablet of which is required to be subjected to a weight check, can be adjusted and prescribed as a desired value to the computer 43. In order to determine this pair of rams, there are conveniently provided on the tablet press, immediately in front of the ejector station 62 in the direction of rotation, two approach switches 63 and 64, of which the one approach switch 63 feeds a signal to the computer 43 at each complete revolution of the die table, and of which the other approach switch 64 delivers a signal to the computer when each pair of rams travels past. The computer 43 counts these signals and compares them with the desired value adjusted in the adjusting device 61 and passes an output signal to the ejector device 62 every time the pair of press rams preadjusted by its number travels past the approach switch 64. The tablet produced by this pair of press rams, e.g. by the number 16 pair of press rams, is then directed by an appropriate ejector, e.g. by a point interposed in the tablet stream, via a chute into the weighing device 47, where, as described in detail above, it is weighed and sets the regulating installation explained in detail above in motion by its measured values.

It is possible by means of the control device 60, e.g. to subject the tablet produced by number 16 ram pair each time to a weight check at every revolution of the die turntable. It is however also possible to adjust the device 61 so that during consecutive revolutions of the die turntable the tablet of a different pair of press rams is weighed each time, possibly so that the number 1 ram pair at the first passage, the number 2 ram pair at the second passage, the number 3 ram pair at the third passage etc. supplies the tablet which is subjected to a weighing. By this means it is possible to check continuously the function of all the pairs of press rams and the weight of the tablets produced by them.

A printer 66, which is also connected to the computer 43, prints out the weight of the particular tablet tested and the number and the pressure of the pair of rams responsible for the production of the tested tablet.

The invention is not limited to the exemplary embodiments, but a number of variations and amplifications are possible without departing from the ambit of the invention. It is possible e.g., in the case of weight variations, to modify the tablet thickness and the pressure prescription simultaneously. In this case the computer then determines the two signal fractions separately. It is moreover also possible to modify the mutual interval of the pressure rollers 23 and 24 in a different manner, e.g. to construct one of the bearing arms as a pivotable lever.

I claim:

1. In a tablet press for producing tablets from particulate material and which tablet press comprises, (a) a die plate having a bore for receiving particulate material; (b) an adjustable dosing device for feeding a metered amount of particulate material into the bore for forming each tablet; (c) upper ad lower rams reciprocable together in a compression stroke in the bore to compress the particulate material into a tablet and having a preset separation of the rams at the end of this compression stroke which preset separation determines the thickness of the tablet formed; (d) means for measuring the compression pressure existing at the end of the compression stroke of the rams; (e) means for comparing said measured pressure with preselected upper and lower pressure limits and for generating a pressure error signal if said limits are exceeded by the measured pressure; and (f) adjustment means responsive to said pressure error signal for varying the amount of particulate material fed to the bore by the dosing device until the measured pressure on subsequent compression strokes falls within the preselected upper and lower limits, the improvement comprising:

means for sampling and weighing the tablets produced at spaced time intervals;

means for comparing the weight of each tablet so sampled to preselected upper and lower weight limits and for generating a weight error signal if said weight limits are exceeded; and, means responsive to the weight error signal for varying the preset separation of the rams at the end of the compression stroke and/or the preselected upper and lower pressure limits until the weight of further sampled tablets falls within the preselected weight limits.

2. The tablet press as recited in claim 1, wherein said means for measuring the compression pressure and said means for sampling and weighing produce signals corresponding to the weight and pressure respectively, and wherein a computer forms both said means for comparing said measured pressure and said means for comparing the weight of each tablet.

3. The tablet press as recited in claim 1, wherein both the rams are acted on by respective pressure rollers mounted in bearings and said means for measuring the compression pressure comprises measuring devices mounted in the bearings of the pressure rollers, and a servo-motor is provided for reciprocating the bearings away from or towards each other thereby to adjust the preset separation of the rams at the end of their compression stroke, said servo-motor forming the means responsive to the weight error signal.

4. The tablet press as recited in claim 3, wherein the servo-motor is a step motor, with the length of the step determined by the magnitude of the weight error signal.

5. The tablet press as recited in claim 1, wherein a mechanical device is provided for presetting said preselected upper and lower pressure limits having a servo-motor for varying the limits selected, said servo-motor forming said means responsive to the weight error signal.

6. The tablet press as recited in claim 5, wherein the servo-motor is a step motor, with the length of the step determined by the magnitude of the weight error signal.

7. The tablet press as recited in claim 2, wherein the computer also controls a printer providing a print-out of the weights of the sampled tablets.

8. The tablet press as recited in claim 7, wherein the tablet press is a rotary die press having a plurality of cooperating pairs of rams.

9. The tablet press as recited in claim 7, wherein the computer also controls the printer to identify the pair of rams associated with each weighed sample tablet.

10. The tablet press as recited in claim 3, wherein the pressure rollers bearings are mounted on bearing arms which are interconnected by at least one tie rod to form an articulated frame with the length of the tie rods being adjusted by an adjusting gear which is driven by the servo-motor.

11. The tablet press according to claim 1, wherein said means for sampling and weighing tablets comprises a steering device for selecting and separating single tablets and a weighing device to which these tablets are fed.

* * * * *